United States Patent [19]

Martini et al.

[11] 4,400,294

[45] Aug. 23, 1983

[54] MIXTURES OF OPTICAL BRIGHTENERS

[75] Inventors: Thomas Martini; Günter Rösch, both of Bad Soden am Taunus, Fed. Rep. of Germany

[73] Assignee: Hoechst Aktiengesellschaft, Fed. Rep. of Germany

[21] Appl. No.: 439,946

[22] Filed: Nov. 8, 1982

Related U.S. Application Data

[63] Continuation of Ser. No. 239,650, Mar. 2, 1981, abandoned.

[30] Foreign Application Priority Data

Mar. 7, 1980 [DE] Fed. Rep. of Germany ..... 3008812

[51] Int. Cl.[3] ..... C11D 7/26; D06L 3/12

[52] U.S. Cl. ..... 252/301.24; 252/301.22; 252/301.25; 252/301.21

[58] Field of Search ..... 252/301.22, 301.24, 252/301.25

[56] References Cited

U.S. PATENT DOCUMENTS

| | | | |
|---|---|---|---|
| 4,061,860 | 12/1977 | Kormany et al. | 252/301.24 |
| 4,105,399 | 8/1978 | Luthi | 252/301.24 |
| 4,142,044 | 2/1979 | Gunther et al. | 542/464 |
| 4,208,513 | 6/1980 | Burdeska | 252/301.24 |

FOREIGN PATENT DOCUMENTS

| | | | |
|---|---|---|---|
| 1955310 | 5/1971 | Fed. Rep. of Germany | 252/301.28 |

OTHER PUBLICATIONS

Research Disclosure 15824, Jun. 1977, Chem. Abs., vol. 87, Abstract 41076u, (1977).

Yamauchi et al., Chem. Abs., vol. 83, Abstract 61504c, (1975).

Gunther et al., Chem. Abs., vol. 93, Abstract 151588u, (1980).

*Primary Examiner*—F. Edmundson

*Attorney, Agent, or Firm*—Connolly and Hutz

[57] ABSTRACT

Mixtures of optical brighteners consisting of (a) 1 to 99 weight % of one or several compounds of the formula 1

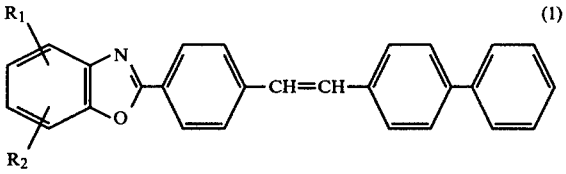

(1)

(b) 99 to 1 weight % of one or several compounds of the formula 2

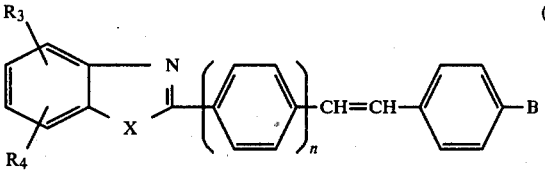

(2)

wherein n is 0 or 1,

X is oxygen or sulfur,

B is a group of the formulae

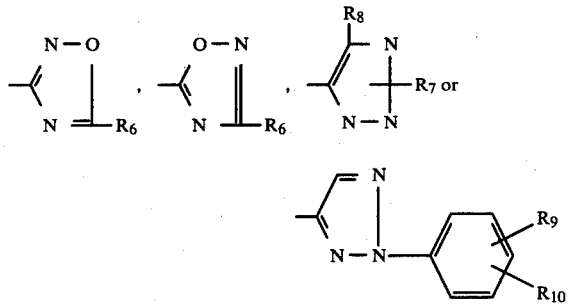

and the other substituents are defined a specified in the description.

3 Claims, No Drawings

MIXTURES OF OPTICAL BRIGHTENERS

This application is a continuation of copending application Ser. No. 239,650 filed Mar. 2, 1981, now abandoned.

It is known that mixtures of optical brighteners yield a greater whiteness than the respective individual components used in the same quantity. This synergistic effect was observed with mixtures, the individual components of which have greatly different shades, for example a violet-tinged and a blue-greenish shade. It has now been found that this synergistic effect resulting in an improved whiteness, can likewise be observed with brighteners having shades that differ only slightly from one another.

Subject of the present invention are mixtures of optical brighteners consisting of (a) 1 to 99 weight % of one or several compounds of the formula 1

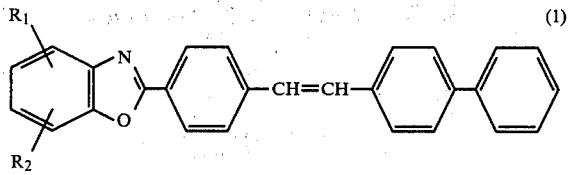

(1)

wherein $R_1$ and $R_2$ are identical or different and represent hydrogen or alkyl, and (b) 99 to 1 weight % of one or several compounds of the formula 2

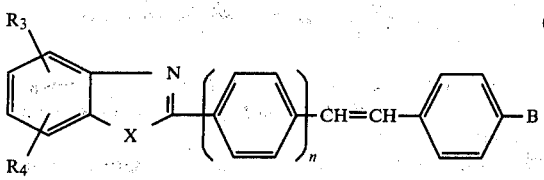

(2)

wherein n is 0 or 1, preferably 1,

X is oxygen or sulfur, $R_3$ and $R_4$, which may be identical or different, are a radical selected from the group consisting of hydrogen, fluorine or chlorine atoms, phenyl, trifluoromethyl, $C_1$–$C_9$ alkyl, alkoxy, dialkylamino, acylamino, cyano, carboxy, carboalkoxy, carboxamide, sulfonic acid, sulfonamide or sulfonic acid alkyl esters, two adjacent radicals $R_3$ and $R_4$ forming optionally together a benzo ring, lower alkylene or 1,3-dioxapropylene, B is cyano, a group of the formula —$COOR_5$ or $CONR_5R_5$, in which $R_5$ is hydrogen, $C_1$–$C_{18}$ alkyl, cycloalkyl, aryl, alkylaryl, haloaryl, aralkyl, alkoxyalkyl, haloalkyl, hydroxyalkyl, alkylaminoalkyl, carboxyalkyl or carboalkoxyalkyl, or two alkyl or alkylene radicals falling under the definition of $R_5$ forming optionally, together with the nitrogen atom, a morpholine, piperidine or piperazine ring, or B is a group of the formulae

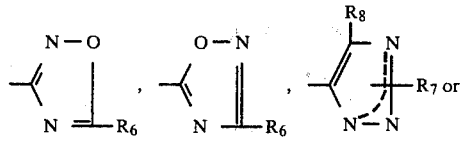

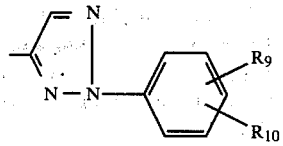

wherein $R_6$ is straight-chain or branched alkyl with 1–18, preferably 1–6, C atoms, which may be substituted by hydroxy groups, halogen atoms, alkoxy, dialkylamino, alkylmercapto, chloroaryloxy, aryloxy, arylmercapto or aryl radicals, both alkyl radicals in the case of dialkylaminoalkyl, forming optionally together a morpholine, piperidine or piperazine ring, or $R_6$ is a group of the formula —$(CH_2CH_2O)_n$—R in which n is 1, 2 or 3 and R is H, alkyl, dialkylaminoalkoxyalkyl or alkylthioalkoxyalkyl, the dialkyl groups of dialkylaminoalkoxyalkyl forming optionally together a piperidine, pyrrolidine, hexamethyleneimine, morpholine or piperazine ring, or $R_6$ is a radical of the formula

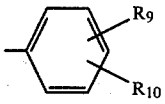

wherein $R_9$ and $R_{10}$, which may be the same or different, represent a radical selected from the group consisting of hydrogen, fluorine or chlorine atoms, phenyl, alkyl, alkoxy, acylamino, cyano, carboxy, carboalkoxy, carboxamide, sulfonic acid, sulfonamide or sulfonic acid alkyl esters, two adjacent radicals $R_9$ and $R_{10}$ forming optionally together an alkylene group, a fused benzo ring or a 1,3-dioxapropylene group, $R_7$ is a hydrogen atom, triphenylmethyl or lower alkyl, which may be substituted by lower carbalkoxy, carboxamide, mono- or dialkylcarboxamide, carboxy or benzoyl and $R_8$ is a cyano group or a group of the formulae

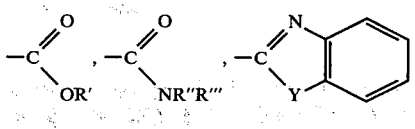

wherein

R′, R″ or R‴ represent hydrogen, lower alkyl or phenyl, the lower alkyl radicals being optionally substituted by hydroxy, lower alkoxy, lower dialkylamino or halogen atoms, lower alkyl or lower alkoxy and R″ and R‴ forming optionally together a saturated bivalent radical, Y is O, S or N-R in which R is hydrogen or $C_1$–$C_4$ alkyl or B is a group of the formula

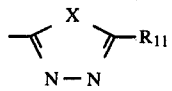

wherein

X is oxygen or sulfur, $R_{11}$ is a phenyl ring, which may be substituted by one or two chlorine atoms, one or two alkyl or alkoxyalkyl groups, a phenyl, cyano, carboxy, carbalkoxy, carboxamide, sulfonic acid, sulfonamide or sulfonic acid alkyl ester group.

Preferred compounds of the formula 1 are compounds of the formula 1a

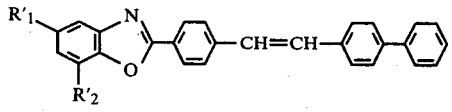

(1a)

wherein $R_1'$ and $R_2'$ have the abovementioned meanings.

Preferred compounds of the formula 2 are compounds of the formula 2a

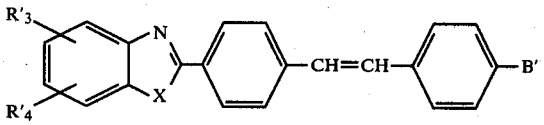

(2a)

wherein $R_3$ and $R_4$ represent together a fused phenyl ring or, when being in the 5 or 7 position, hydrogen or chlorine, alkyl, phenyl, X is oxygen or sulfur and B' is a group of the formulae

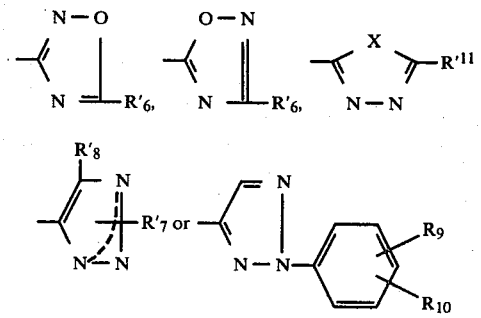

wherein $R_6'$ is alkyl, chloroalkyl, alkoxyalkyl, hydroxyalkyl or a group of the formula $-(CH_2CH_2O)_n-R$ in which n is 1, 2 or 3 and R is hydrogen or alkyl, $R_{11}'$ is phenyl, which may be substituted by one or two chlorine atoms, one or two alkyl or alkoxy groups, a phenyl, cyano, carboxyl, carboalkoxy, carboxamide, sulfonic acid, sulfonamide or sulfonic acid alkyl ester group, $R_8'$ is cyano or carboalkoxy and $R_7'$ is alkyl.

Particularly preferred amongst the compounds of the formula 2 are compounds of the formula

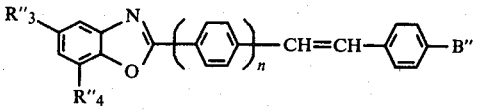

wherein $R_3''$ and $R_4''$ are hydrogen or alkyl, n is 1 or 0 and

B'' is a group of the formulae

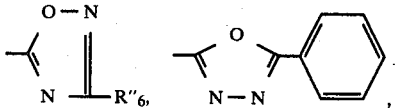

—CN or —COOalkyl and $R_6$ is alkyl or methoxyethyl. Particularly important amongst the compounds covered by formula 2 are the following compounds:

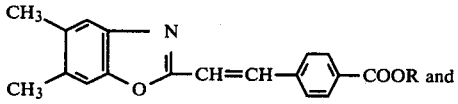

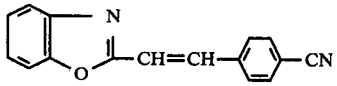

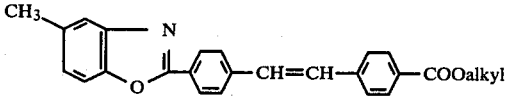

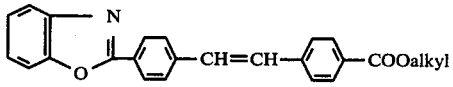

Unless stated otherwise, alkyl and alkoxy groups as well as other groups derived therefrom contain of from 1 to 4 carbon atoms.

The compounds of the formula 1 are known from German Pat. No. 1,594,834 and the compounds of formula 2 are known from German Offenlegungsschrift No. 2,709,924 and from the published Japanese Pat. Nos. Sho 51/40090 and Sho 70/4568.

The mixing ratio of the individual components is between 1 and 99% by weight of component of formula 1 and, correspondingly, 99 to 1% by weight of the other compound of the formula 1. These compounds of the formulae 1 or 2 can be employed on their own or can also be employed in any desired mixture with one another; the mixing ratio of these compounds with one another is entirely non-critical and can be varied as desired. A mixing ratio of 50 to 99% by weight of component of formula 1 and 50 to 1% by weight of component of formula 2 is preferred.

In an individual case, the optimum mixing ratio of all compounds depends on the structure of the particular compounds and can be determined without difficulty by simple preliminary experiments.

As is customary in the case of optical brighteners, the individual components are brought into a commercial form by dispersing in a liquid medium, for example water. The individual components can each be dispersed on their own and these dispersions can then be added together. However, the individual components can also be mixed with one another in the solid form and then dispersed together. This dispersing process is effected in a conventional manner in ball mills, colloid mills, bead mills or dispersion kneaders. The mixtures according to the invention are particularly suitable for brightening textile material made of linear polyesters, polyamides and acetylylcellulose. However, these mixtures can also be used with good result on mixed fabrics which consist of linear polyesters and other synthetic or natural fiber materials, specifically fibers containing hydroxyl groups and in particular cotton. These mixtures are applied under the conditions customary for the use of optical brighteners, such as, for example, by the exhaustion process at 90° C. to 130° C. with or without the addition of accelerators (carriers) or by the thermosol process. The brighteners which are insoluble in water and the mixtures according to the invention can also be used in the form of a solution in organic solvents, for example perchloroethylene or fluorinated hydrocarbons. The textile material can be treated by the exhaustion process with the solvent liquor which contains the optical brightener in solution, or the textile material is impregnated, padded or sprayed with the solvent liquor containing the brightener and is then dried at temperatures of 120°-220° C., during which operation all of the optical brightener is fixed in the fiber. Outstandingly brightened goods are obtained which have excellent stability to light and also stability to oxidizing agents and reducing agents, the whiteness reached when using the mixture according to the invention being distinctly greater than that obtained when using only one compound of formula 1 or 2, respectively, in the same quantity.

The following examples illustrate the invention:

EXAMPLE 1

Cut pieces of a fabric of polyester staple fibers are washed, dried and impregnated on a padder with aqueous dispersions which contain either the pure optical brightener of the formula 1 or 2, respectively, for comparison, or a mixture of both brighteners, in a weight ratio of 8:2, relative to the amount of active substance. The brighteners of the formula 1 are used in the form of a commercial dispersion (20% concentration). The brighteners of formula 2 are used as a 10% dispersion in a polyvinyl alcohol. The total quantity of brightener amounts to 1.66 g/l. The material is squeezed off between rollers using a padder so that the wet pick up is about 80%. The padded material is then dried at 110° C. and subsequently subjected to a thermosol treatment on a tenter fame at the temperatures indicated in the table. The degree of whiteness according to Ganz indicated in each case were obtained. The whiteness was measured using a type DMC-25 reflectance spectrophotometer (Messrs. Carl Zeiss, Oberkirchen). The shade was determined using the following equation according to Ganz: $N=-1{,}132.0X+725.0Y+115.46$.

Component 1 — 80 weight %

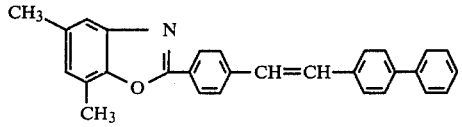

Component 2 — 20 weight %

-continued

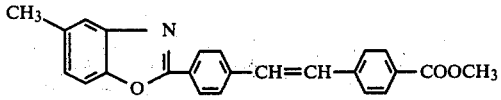

Component 3 — 20 weight %

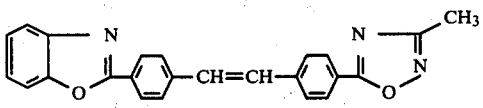

| | | whiteness | Shade |
|---|---|---|---|
| 100 weight % of Comp. 1 | 180° | 231 | −0.1 B |
| | 190° | 237 | 0.3 B |
| | 200° | 239 | 0.4 B |
| | 210° | 235 | 0.3 B |
| 100 weight % of Comp. 2 | 180° | 215 | 0.0 B |
| | 190° | 216 | 0.0 B |
| | 200° | 214 | 0.0 B |
| | 210° | 214 | 0.0 B |
| 100 weight % of Comp. 3 | 180° | 218 | 0.0 B |
| | 190° | 228 | 0.0 B |
| | 200° | 227 | 0.0 B |
| | 210° | 227 | 0.0 B |
| mixture of components 1 and 2 in a ratio of 80:20 | 180° | 238 | 0.4 B |
| | 190° | 241 | 0.2 B |
| | 200° | 243 | 0.1 B |
| | 210° | 241 | 0.2 B |
| mixture of components 1 and 3 in a ratio of 80:20 | 180° | 239 | 0.4 B |
| | 190° | 240 | 0.4 B |
| | 200° | 242 | 0.1 B |
| | 210° | 242 | 0.2 B |

EXAMPLE 2

100 mg of a mixture consisting of 80 weight parts of component 4

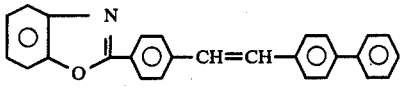

and 20 weight parts of component 3 or of 100 mg of the pure components 3 and 4, respectively, are dissolved in a mixture of 5 ml of dimethyl formamide and 5 ml of a 85% nonylphenol oxethylate having 22–26 EO units and the resultant clear solution is added uniformously, while stirring, into 90 g of ice water. The resulting dispersion is used for the procedure specified in Example 1.

After having applied the dispersion onto a fabric of PES staple fibers by a thermosol process at 190° C. for 30 seconds, there are obtained the following degrees of whiteness:

| | whiteness | shade |
|---|---|---|
| component 3 | 234 | 0.1 B |
| component 4 | 235 | 0.6 G |
| mixture of components 3 and 4 in a ratio of 20:80 | 240 | 0.7 G |

EXAMPLE 3

The procedure is as specified in Example 1, the thermosol temperature being, however, 200° C. The following components were used:

(a) 2 g/l of the brightener of the formula

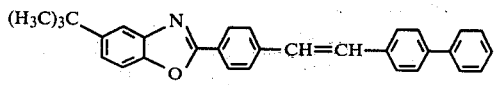

(b) 2 g/l of the brightener of the formula

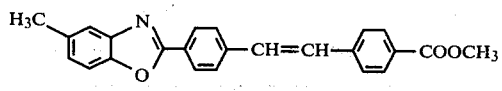

(c) 2 g/l of a mixture of 80 weight % of the brightener specified sub (a) and 20 weight % of the brightener specified sub (b).

There were obtained the following degrees of whiteness:

| Brightener | Whiteness | Shade |
|---|---|---|
| (a) | 225 | 0.6 G |
| (b) | 217 | −0.3 B |
| (c) | 233 | 0.1 B |

What is claimed is:

1. Mixtures of optical brighteners consisting essentially of 1 to 99 weight % of a compound of the formula

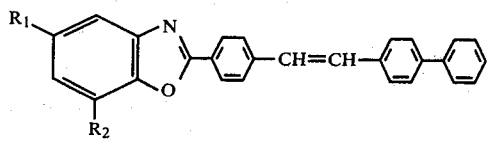

(1)

and 99 to 1 weight % of a compound of the formula

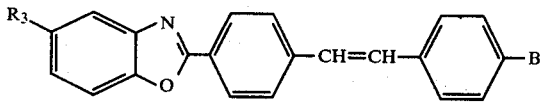

(2)

wherein:

$R_1$ and $R_2$ are the same or different and are hydrogen or $C_1$–$C_4$ alkyl, $R_3$ is hydrogen or $C_1$–$C_9$ alkyl, and B is a group of the formula —$COOR^5$, wherein $R^5$ is $C_1$–$C_{18}$ alkyl, or B is

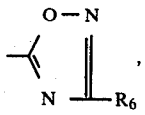

wherein $R^6$ is $C_1$–$C_6$ alkyl.

2. Mixtures of optical brighteners as claimed in claim 1 wherein $R_1$ is hydrogen, methyl or tertiary butyl; $R_2$ is hydrogen or methyl; $R_3$ is hydrogen or methyl; and $R_5$ and $R_6$ are methyl.

3. Mixtures of optical brighteners as claimed in claim 1, said mixtures comprising 50–99 weight % of a compound of Formula (1) and 50–1 weight % of a compound of Formula (2).

* * * * *